US006938952B2

(12) United States Patent
Dauterive

(10) Patent No.: US 6,938,952 B2
(45) Date of Patent: Sep. 6, 2005

(54) UNIVERSAL HIGH CHAIR

(75) Inventor: Paul E. Dauterive, Dallas, TX (US)

(73) Assignee: Shoreworks, LLC, Park City, UT (US)

( * ) Notice: Subject to any disclaimer, the term of this patent is extended or adjusted under 35 U.S.C. 154(b) by 0 days.

(21) Appl. No.: 10/185,973

(22) Filed: Jun. 28, 2002

(65) Prior Publication Data

US 2003/0057745 A1 Mar. 27, 2003

Related U.S. Application Data

(60) Provisional application No. 60/303,796, filed on Jul. 9, 2001.

(51) Int. Cl.[7] ..... A47C 13/00

(52) U.S. Cl. ..... 297/130; 297/3; 297/1; 297/118; 297/283.1; 297/283.2

(58) Field of Search ..... 297/1, 3, 130, 297/118, 283.1, 283.2, 129, 2; D6/1, 3, 8

(56) References Cited

U.S. PATENT DOCUMENTS

| | | | | | |
|---|---|---|---|---|---|
| 2,269,834 | A | * | 1/1942 | Wagner | 182/33.2 |
| D248,516 | S | * | 7/1978 | Johansson | D6/1 |
| 4,205,876 | A | * | 6/1980 | Cetina | 297/118 |
| 4,565,403 | A | * | 1/1986 | Brown | 297/3 |
| 5,230,523 | A | * | 7/1993 | Wilhelm | 280/30 |
| 5,413,399 | A | * | 5/1995 | Myers et al. | 297/118 |
| 5,507,549 | A | * | 4/1996 | Cope | 297/129 |
| 5,690,379 | A | * | 11/1997 | Cayssials | 297/118 |
| 6,010,184 | A | * | 1/2000 | Lee et al. | 297/130 |
| 6,074,007 | A | * | 6/2000 | Helmsderfer et al. | 297/335 |
| 6,082,814 | A | * | 7/2000 | Celestina-Krevh et al. | 297/118 |
| 6,089,651 | A | * | 7/2000 | Carmen | 297/16.1 |
| 6,367,874 | B2 | * | 4/2002 | Casini | 297/118 |

OTHER PUBLICATIONS

Web Page from www.don.com/Catalog/Product.asp, p. 1, Mar. 16, 2001.
Web Pages from http://babygearreview.com/guides/high-chair/shtml, pp. 1–2, Jun. 13, 2001.
Web Pages from http://babygearreview.com/guide/high-chair_guide3.shtml, pp. 1–2, Jun. 13, 2001.
Web Pages from GracoBaby.com website showing EASY CHAIR (Model 3165), NEAT SEAT (Model 3650), and DOUBLETRAY (Models 3865 & 38480, pp. 1–5 (as marked), Jun. 13, 2001.

* cited by examiner

*Primary Examiner*—Peter M. Cuomo
*Assistant Examiner*—Erika Garrett
(74) *Attorney, Agent, or Firm*—Grady K. Bergen

(57) ABSTRACT

A high chair is provided that can be used in different modes. The high chair is provided with a seating surface for supporting a child in an elevated position in one mode. The chair can be inverted and used to support a child carrier at an elevated position in a second mode. The chair is configured so that it rests on a generally flat support surface in a non-tilted orientation. A stabilizer may also be provided to further stabilize the chair. A stabilizer is also provided for use with the high chair or high chair of conventional design when such chairs are inverted and used to support child carriers.

17 Claims, 3 Drawing Sheets

UNIVERSAL HIGH CHAIR

This application claims the benefit of U.S. Provisional Application Ser. No. 60/303,796, filed on Jul. 9, 2001.

TECHNICAL FIELD

The invention relates to high chairs for seating infants and young children.

BACKGROUND

High chairs have been used for many years to provide parents or child caregivers a means for seating a young child at table level to facilitate feeding of the child and to allow the child to share in meals along with others at the dinner table. These chairs are usually designed for children who are able to sit upright without assistance. There are many different designs for these high chairs and they may be formed from many different materials, such as wood, metal or plastic. In some designs a tray is provided with the high chair to provide a surface that the child can easily access. The chairs may be collapsible for storing or may have a non-collapsible fixed frame. Oftentimes straps, belts or other means are provided with the chair to secure the child in place.

One high chair design that is commonly found in many restaurants and public eating-places is that shown in FIG. 1. Although there may be slight variations to this design, they generally have a similar configuration. The chair 10 usually consists of a frame 12 for supporting an elevated seating surface 13. A seatback 14, arms 16 and front cross member 18 serve to hold the child in place upon the seat 13. Located near the base 20 of the frame 12 are front and rear cross members 22, 24, respectively. This design is particularly well suited for seating young children when the child is placed upon the seat 13 and secured in place in a normal fashion.

Unless specially designed high chairs are available, children that are too small to be seated in such high chairs are oftentimes kept in removable car seats or baby carriers that are brought to the dining table. In such cases, the baby carrier and child are usually placed on the surface of the dining table, or on the floor or on a seat surface adjacent to the dining table. Because baby carriers take up a relatively large amount of space and the amount of table surface may be limited, it is often undesirable to place the child and child carrier on the surface of the table. In the later two cases, the child is often out of view of those sitting around the table, making this method undesirable as well.

In order to overcome these disadvantages, the chair 10 is sometimes misused by some for supporting a baby carrier. This is usually accomplished by inverting the chair 10 so that top or upper portion of the chair 10 rests on the floor surface, as shown in FIG. 2. The baby carrier holding the child is then rested on the two cross members 22, 24 located at the base 20 of the chair. Although this may allow the baby and carrier to be positioned at an elevated level adjacent to the table, which may desirable, it can also endanger the child because the inverted chair may be unstable. The top of the chair is usually much smaller and has a smaller footprint than the base 20 so that the inverted chair is much more prone to tipping over. Further, as shown in FIG. 2, the chair back 14 extends above the arms 16 so that when the chair 10 is inverted, the chair 10 does not rest flush or level on the arms of the chair, but instead rests on the forward corners 26 of the arms and the edge of the seat back 14 so that it is sloped or tilted at an angle relative to the floor. This only adds to the instability of these chairs when misused in this way.

What is therefore needed is a high chair that can be easily adapted for use both for seating young children unassisted and for supporting a baby carrier at an elevated position and without endangering the child.

BRIEF DESCRIPTION OF THE DRAWINGS

For a more complete understanding of the present invention, and the advantages thereof, reference is now made to the following descriptions taken in conjunction with the accompanying figures, in which.

DETAILED DESCRIPTION

Figure 3:
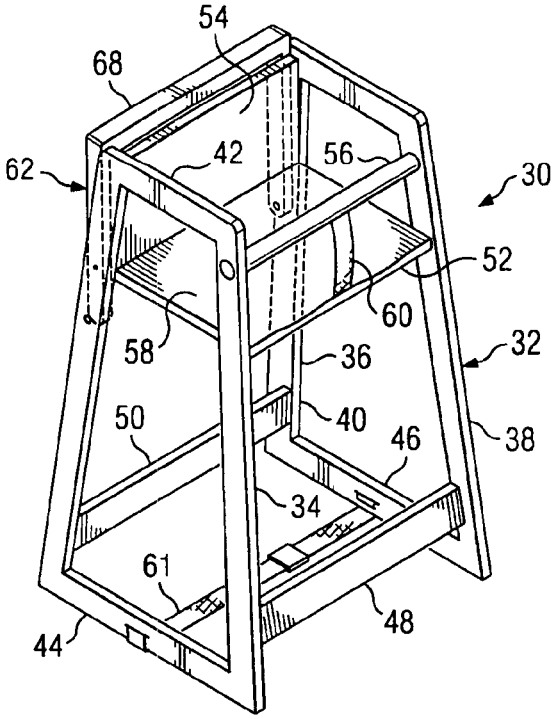
FIG. 3 is a perspective view of a high chair.
Figure 4:
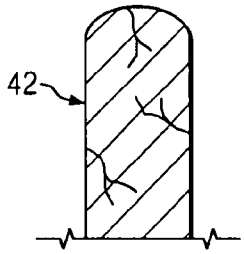
FIG. 4 is an elevational cross-sectional view of a cross-member of the high chair of FIG. 3.

Referring to FIG. 3, a high chair 30 is shown. The chair 30 is comprised of a frame 32 of wood, plastic or other suitable material. The frame 32 has right and left side members 34, 36. Each side member 34, 36 is generally constructed the same and has front and rear legs 38, 40, which are joined together at the ends by upper and lower side cross members 42, 44, respectively. Because the chair 30 can be inverted depending upon the mode of use, for ease of description, and unless otherwise noted, references to "upper," "lower" and similar terms that are dependent upon the orientation of the chair are made with reference to the chair 30 in the position shown in FIG. 3. In the embodiment shown, each side member has a generally trapezoidal configuration, with the upper member 42 being parallel but shorter in length than the lower member 44 so that the legs 38, 40 flare outward towards the base or lower portion 46 of the chair 30. Although one particular configuration is shown, it should be noted that the chair 30 and the components and members forming the chair 30 could have various shapes and configurations.

The base or lower end 46 of the chair 30 has contact areas for contacting the floor or support surface. In the embodiment shown, the lower members 44 provide the contact areas or surfaces for contacting the floor or support surface. The contact areas may lie in a plane that is perpendicular to the longitudinal axis of the chair 30 so that the chair 30 will rest on a flat floor or support surface in an upright or generally non-tilted orientation, in which the longitudinal axis of the chair 30 is generally perpendicular to the flat floor or support surface.

Positioned near the base 46 of the chair 30 are front and rear cross pieces or members 48, 50, joining the side members 34, 36 together. The front and rear cross members 48, 50 are generally straight members, although they may be otherwise configured, and are parallel to each other and located several inches, from about 5 or less to about 10 inches or more, above the lowermost end of the chair frame 32, when positioned as shown in FIG. 3. The cross members 48, 50 may be an equal distance from the lowermost end of the frame 32, but can be offset to some degree, as well to facilitate holding of a baby carrier in a generally level position, as is described later on.

A seating surface 52 is provided that is interposed and otherwise secured between the side members 34, 36 or frame 32 for supporting a young child. The frame 32 may be tall enough so that the seating surface 52 is held at an elevated position when the frame 32 is resting on the floor or support surface so that a young child is generally at table level when seated thereon. Table level may very, but may be anywhere from about 20 inches or less to about 40 inches or more, and more typically from about 26 inches to about 36 inches above the floor or support surface. The seating surface 52 may be flat or contoured and may be padded or cushioned, if desired. The seating surface 52 is positioned several inches below the upper cross members 42.

Figure 6:
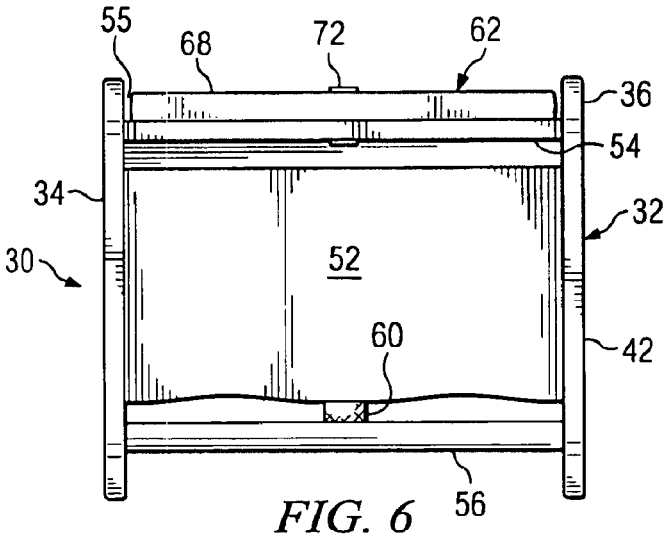
FIG. 6 is a top plan view of the high chair of FIG. 3.

A seat back 54 extends across the upper portion of the rear legs 40 of the frame 32. As shown in FIG. 6, the seat back 54 is set inward slightly from the rearward edge of the rear legs 40 to define a recessed area 55. The upper edge or end of the seat back 54 may be generally flush or level with the upper cross members 42. As can be seen, the upper side members 42 serve as arms of the high chair when a young child is seated upon the seating surface 52.

Figure 5:
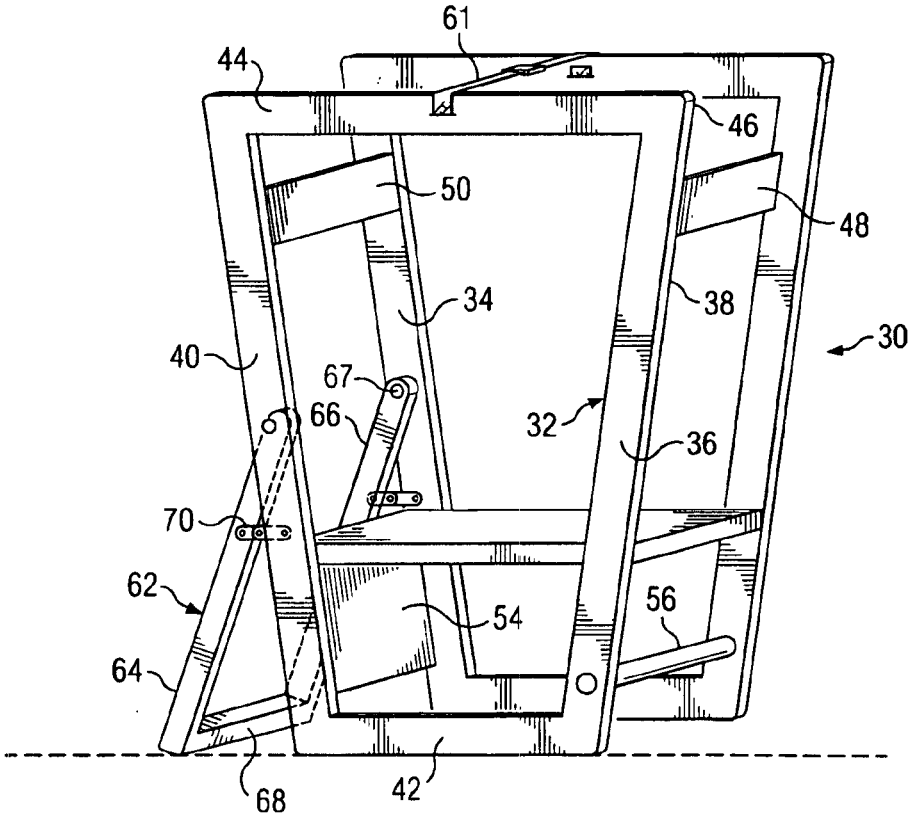
FIG. 5 is side elevational view of the high chair of FIG. 3, shown in a baby-carrier-supporting mode of operation.

Extending between and joining the upper portion of the front legs 38 is a front cross member 56. The upper edge or end of the cross member 56 may be flush or level with the side members 42, as well, so that the uppermost edge or ends of the seat back 54, cross members 42 and cross member 56, which form floor or support surface contact areas as is discussed later on, lie in a single plane. The seat back 54, cross member 42 and cross member 56 constitute a perimeter of the upper end of the chair and define a footprint of the upper end of the chair 30 when the chair is inverted in the carrier mode to support a child carrier. The surface contact areas are generally located along this perimeter. The plane formed by the contact areas may be perpendicular to the longitudinal axis of the chair 30. Although the upper ends or edges of the seat back 54, cross member 42 and cross member 56 may constitute generally flat, continuous surfaces, they may also have rolled or curved surfaces, as is shown in FIG. 5, to avoid sharp corners, or be otherwise beveled or contoured, and may be non-continuous along the length of the members 42, 56 and seat back 54 forming the perimeter of the upper end of the chair 30. Additionally, the lower members 44 or members forming the lower end or base of the chair 20 that contact the floor or support surface, may be similarly configured.

The cross member 56 is positioned above the seating surface 52 to provide an opening 58 through which a child's legs and feet can be passed. The member 56 may serve as a guard or rail for retaining a child upon the seat should the child try to lean forward. A strap or other retaining device 60 is provided that extends between the seating surface 52 and guard member 56 to prevent the child from passing through the opening 58.

In the embodiment shown, the side members 34, 36 are angled inward toward the upper end of the frame 32 so that the base 46 is wider, and thus more stable. This also provides a more confining space defined by the seat back 54, arms 42 and cross member 56 at the upper end of the chair to minimize movement of the child once seated on the seating surface 52. The footprint of the upper end of the chair 20 may cover a smaller area than does the does the base 46. The smaller upper end also facilitates stacking of the chairs, with the base 46 being provided with a recess for receiving the upper end of a chair of the same or similar design so that the chairs can be stacked one on top of the other for storage.

The difference in area of the footprints between the upper end and lower end of the chair may vary, however, with the footprint of the upper end of the chair being the same or even larger than that of the base or lower end. Where the footprint of the upper end of the chair 20 is smaller than that of the base it may vary anywhere from less than 100% to 20% of the area of the base or lower end, with from 30% to 60% being more typical, without the stabilizer as is discussed below.

A carrier strap 61 may also be provided at the base of the chair 30 for retaining a baby carrier when the chair is used for supporting a baby carrier, as described later on.

Referring now to FIG. 5, the chair 30 is shown in an inverted position for use in supporting a baby carrier. When in this position, the uppermost ends of the cross members 42, seat back 54 and cross member 56, which provide floor contact areas, will contact and rest on any generally flat floor or support surface so that the chair 30 may rest in an upright or non-tilted position in which the longitudinal axis of the chair 30 may be generally perpendicular to the floor or support surface.

A stabilizer 62 is also provided with the chair, in the embodiment shown, to add further stability to the chair when in this position. The stabilizer 62 also effectively increases the footprint area of the upper end of the chair, when in this mode. The stabilizer 62 is joined to the rear of the frame 32 between the rear legs 40 and is formed by stabilizer legs 64, 66 that are each pivotally coupled at 67, such as by a hinge, mechanical fastener, or flexible material suitable for such purpose, at one end to one of the rear legs 40 of the frame 32 for movement of the stabilizer 62 between an extended and retracted position. In the embodiment shown, the legs 64, 66 are joined to the rear legs 40 at a location below the seating surface 52, although this position may vary depending upon the length of the legs 64, 66. The legs 64, 66 may be joined together at the opposite ends by a crosspiece or stabilizer bar 68.

Figure 8:
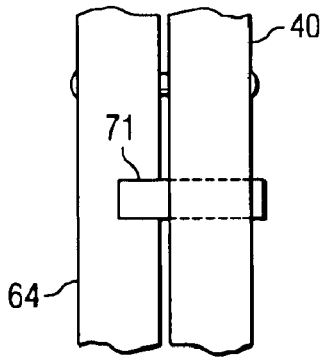
FIG. 8 is a rear elevational view of a stop member for limiting pivotal movement of a stabilizer for use with a high chair.

An expandable hinge 70 may be provided along the midsection of each leg 64, 66 and be coupled to the rear leg 40 for limiting pivotal movement of the legs 64, 66. A flexible or bendable member, such as a wire, fabric, cord, strapping, etc. or other device could also be used in place of the hinge 70, as is shown. While an expandable hinge 70 is shown, other methods or devices may be used to limit pivotal movement of the legs 64, 66. For example, a stationary stop member 71 (FIG. 8) joined or coupled to the rear legs 40 of the frame 32 could limit pivotal movement. The stop member could also be selectively retractable or extendable. As is shown in FIG. 5, the stabilizer 62 is shown in an extended position in which the stabilizer bar 68 is swung outward and away from the seat back 54. When the stabilizer 62 is fully extended, the hinge 70 or device 71 may limit further outward movement of the legs 64, 66 away from the seat back 54. When the stabilizer bar 68 is fully extended, it has a floor contact area that is generally level or flush with the contact areas of the upper edges or ends of the seat back 54, arms 42, and guard rail 56, which rest on the floor or a supporting surface. In one embodiment, the hinge 70 may be a locking hinge so that the hinge locks into place when the hinge is expanded, keeping the stabilizer 62 in the fully extended position until the hinge 70 is unlocked.

When moved to the retracted position, the legs 64, 66 and stabilizer bar 68 are positioned between the rear legs 40 of the frame 32 adjacent to the seat back 54 within the recess 55 so that the stabilizer remains out of the way, as shown in FIG. 6. A releasable fastener 72 may be provided for retaining the stabilizer 62 in the retracted position.

The stabilizer 62 may be formed from a variety of different materials, such as wood, metal and plastic and may be of a variety of different configurations. For example, the stabilizer bar portion 68 may be eliminated so that the ends of the legs 64, 66 provide contact areas for engaging or contact the floor or support surface. The stabilizer 68 may also be biased, such as by a spring or other biasing member or members so that it moves to one of an extended or retracted position by means of the biasing force exerted by the biasing member(s). Additionally, the stabilizer may be of different shapes, such as a curved-U shape, wherein the bottom of the U constitutes the portion of the stabilizer bar 68 contacting the floor. Other shapes and configurations may be used as well. The stabilizer 62 may be of single unitary construction, or may be constructed from multiple components.

A stabilizer (not shown) similar to the stabilizer 68 may also be employed at the lower end of the chair in a similar manner to further facilitate stabilization of the chair 30 when it is used in the seating mode, as it is shown oriented in FIG. 3.

Figure 1:
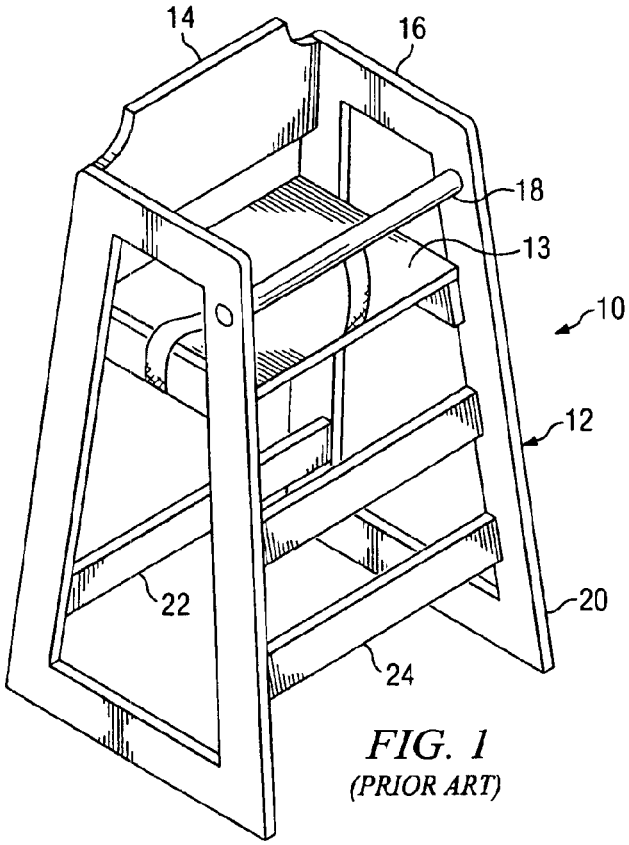
FIG. 1 (PRIOR ART)
FIG. 1 is a perspective view of a prior art high chair commonly used in restaurants and public eating places.
Figure 2:
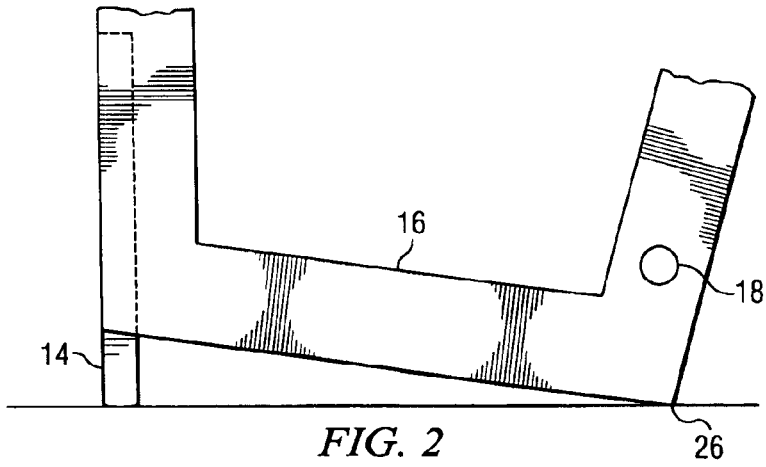
FIG. 2 (PRIOR ART)
FIG. 2 is an elevational side view of the upper portion of the chair of FIG. 1, wherein the chair is in an inverted position.

It should be noted, that the stabilizer may also be employed or retrofitted on prior art or conventional high chairs, as shown in FIGS. 1 and 2, for example, to facilitate use of such chairs in dual seating and carrier modes, as described herein. In this way, the stabilizer 62 acts to stabilize such high chairs so that they may be used to support a child carrier even when they are in a non-upright or tilted orientation, as is shown in to FIG. 2. When used with such prior art or conventional high chairs, the stabilizer may be configured to extend and contact the floor or support surface when extended to provide additional contact areas and provide a larger footprint of the upper end of the high chair when the high chair is used in an inverted manner, as described.

The chair 30 can be used in two different modes. In one mode, the chair 30 is used as a conventional high chair wherein the base 46 of the chair frame 42 rests on the floor or support surface, and a child capable of sitting upright without assistance may be seated and supported at an elevated position upon the seating surface 52. In this mode, the seat back 54, arms 42 and front guard 56 serve to retain the child upon the seat 52. An optional strap or belt (not shown) may also be provided to serve as a seat belt to facilitate holding the child in place within the chair.

The chair 30 can also be inverted and used as an elevated support for a baby carrier and child. In this mode, the chair is turned over so that the upper end of the chair frame 32 rests on the floor or support surface, as shown in FIG. 5. Because the upper edges or ends of the seat back 54, arms 42 and guard 56 are flush and level, generally the entire perimeter of the upper end of the frame 32 will rest solidly on the flat surface of the floor without the need for the stabilizer. Where the contact surface of the upper end of the chair is non-continuous, it may be desirable to provide contact areas that extend at least 50%, 60%, 70%, 80%, 90% or more of the upper end perimeter of the chair. Additional stability may be provided to the chair, when in this mode, by unfastening the fastener 72 and moving the stabilizer 62 to its extended position so that the hinge 70 locks in place and the stabilizer bar 68 engages the floor.

Figure 7:
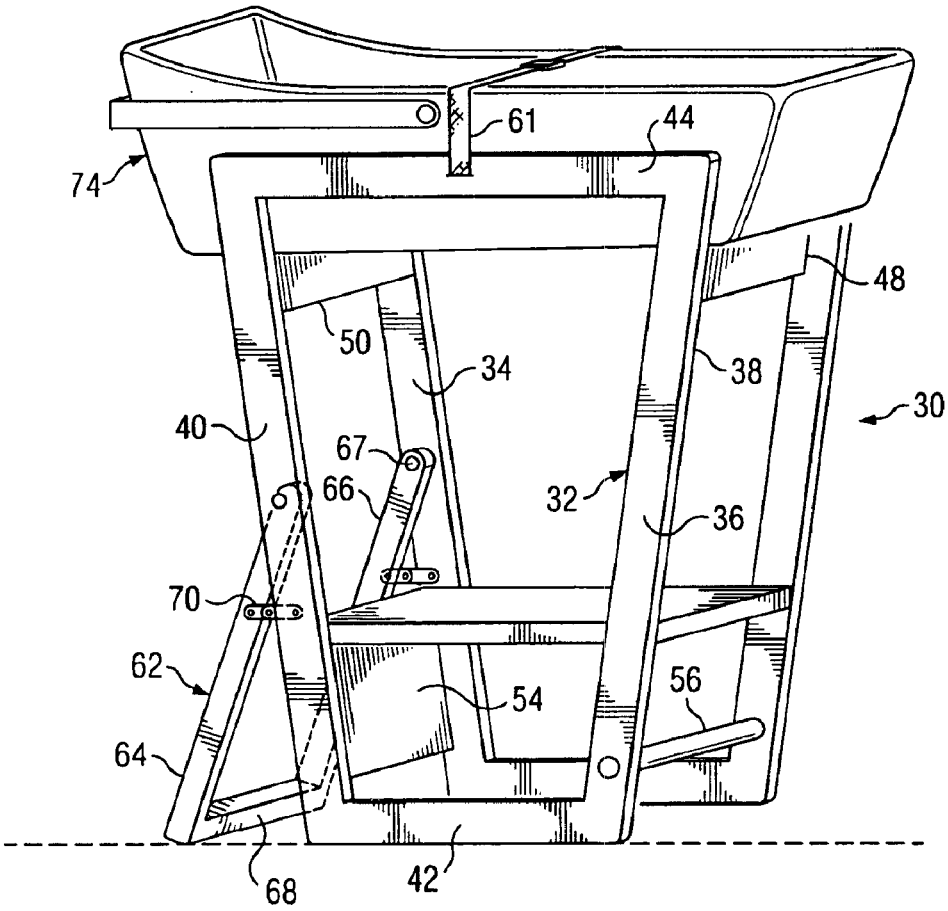
FIG. 7 is a side elevational view of the high chair of FIG. 5, shown supporting a baby carrier.

A baby carrier 74, such as shown in FIG. 7, can then be placed upon the front and rear cross members 48, 50, which serve as a carrier support, between the side members 34, 36 of the frame 32. The side members 34, 36 and supports 48, 50 may be positioned and configured to receive most conventional baby carriers or car seats and maintain them in a generally level orientation or the orientation or position the carrier or car seat was designed to be in when supporting a child. The supports 48, 50 are located at an elevated position above the floor when the upper end of the frame 32 rests thereon so that the baby carrier 74 is generally at table level. The side members 34, 36 extending beyond the supports 48, 50 prevent lateral movement of the baby carrier 74 upon the supports 48, 50.

With the baby carrier supported by the chair frame 32 in this way, the strap 61 can then be secured around the carrier 74 to further facilitate holding the carrier in place upon the chair 30.

When the chair is no longer being used as a baby carrier, the stabilizer can be brought to its retracted position by unlocking the hinge 70 and pivoting the stabilizer 62 to its retracted position. The stabilizer 62 may then be secured in the retracted position by means of the fastener 72 and the chair can then be inverted and used in a normal fashion as a high chair.

The chair is multifunctional yet simple in design. Because the chair is designed to sit level on a flat surface and is further provided with an additional stabilizer, the chair provides a safe means for seating a young child and supporting a baby carrier at elevated positions that are easily accessible to a child care giver when seated around a dining table. The chair can be used in both for private use in the home or in a commercial setting, such as a restaurant, for use by the public.

While the invention has been shown in only one of its forms, it should be apparent to those skilled in the art that it is not so limited, but is susceptible to various changes and modifications without departing from the scope of the invention. For example, it is possible that the stabilizer bar could also be configured to serve as a seat back when moved to the retracted position, thus eliminating the need for a stationarily mounted seat back. And although the chair is shown constructed in a certain configuration, such as the generally rectangular base, the chair may have other configurations or shapes as well, such as a curved, circular or rounded base. Cross members and legs of the chair may also be shaped differently or the chair may be formed from a molded material, such as plastic, or otherwise formed, such that certain individual structural members may be eliminated. Other variations should be apparent to those skilled in the art as well.

I claim:

1. A high chair comprising:

an invertible high chair support structure having a seating end and an opposite carrier end, each end being configured to rest on a generally flat support surface so that the support structure is in a non-tilted orientation when either end rests on the support surface, the seating end resting on the support surface during first mode of operation and the carrier end resting on the support surface during a second mode of operation wherein the high chair support structure is inverted from the first mode of operation;

a seating surface coupled to the support structure, wherein the seating surface is located at an elevated position above the support surface during the first mode of operation;

a child carrier receiving area located opposite the seating surface, wherein the receiving area is located at a second elevated position above the support surface during the second mode of operation; and a stabilizer coupled to the support structure, the stabilizer being configured to engage the support surface to facilitate stabilization of the support structure when in at least one of the first and second modes of operation, the stabilizer being movable between an extended and retracted position to selectively engage the support surface.

2. The high chair of claim 1, further comprising:

a stationary seat back having an upper end terminating at or below the seating end of the support structure.

3. The high chair of claim 1, further comprising:

opposite side arms positioned at either side of the seating surface, the side arms having an upper end terminating at or below the seating end of the support structure.

4. The high chair of claim 1, further comprising:

a stationary seat back having an upper end terminating at the seating end of the support structure; and opposite side arms positioned at either side of the seating surface, the side arms having an upper end terminating at the seating end of the support structure, the upper ends of the side arms and seat back being generally level with one another, each of the upper ends of the side arms and seat back forming a portion of the seating end of the support structure.

5. The high chair of claim 1, further comprising:

a front cross member, the front cross member having an upper end terminating at the seating end of the support structure.

6. The high chair of claim 1, further comprising:

a stationary seat back having an upper end terminating at the seating end of the support structure; and opposite side arms positioned at either side of the seating surface, the side arms having an upper end terminating at the seating end of the support structure; and a front cross member, the front cross member having an upper end terminating at the seating end of the support structure, the upper ends of the side arms, seat back and front cross member being generally level with one another, each of the upper ends of the side arms, seat back and front cross member forming a portion of the seating end of the support structure.

7. The high chair of claim 1, wherein:

the carrier end of the support structure is provided with a recess configured for receiving the seating end, whereby the seating end of another high chair of similar configuration is received within the recess when the chairs are stacked one upon the other.

8. A high chair comprising:

a support structure having opposite seating and carrier ends and including a pair of side frame members that are joined together by front and back cross members, each end of the support structure being configured to stably rest on a generally flat support surface so that the support structure is in a non-tilted orientation when either end rests on the support surface, the carrier end resting on the support surface during a first mode of operation and the seating end resting on the support surface during a second mode of operation;

a seating surface non-removably coupled to the support structure, the seating surface being located at an elevated position above the support surface during the first mode of operation wherein the seating surface is used to support a child thereon;

a child carrier receiving area located opposite the seating surface, the child carrier receiving area being configured to receive and support a child carrier during the second mode of operation, the child carrier receiving area is formed by the front and back cross members, the cross members being located at a position of from 5 inches or more from the carrier end, and wherein the receiving area is located at a second elevated position above the support surface during the second mode of operation; and a stabilizer coupled to the support structure, the stabilizer being configured to engage the support surface to facilitate stabilization of the support structure during at least one of the first and second modes of operation, the stabilizer being movable between an extended and retracted position to selectively engage the support surface.

9. The high chair of claim 8, further comprising:

a stationary seat back having an upper end terminating at the seating end of the support structure; and opposite side arms that are each formed from a portion of one of the side frame members and positioned at either side of the seating surface, the side arms having an upper end terminating at the seating end of the support structure, the upper ends of the side arms and seat back being generally level with one another, each of the upper ends of the side arms and seat back forming a portion of the seating end of the support structure.

10. The high chair of claim 9, further comprising:

a front cross member, the front cross member having an upper end terminating at the seating end of the support structure and being generally level with the upper ends of the seat back and side arms.

11. The high chair of claim 1, wherein:

the support structure is provided with a recess configured for receiving the seating end of another high chair of similar configuration when the chairs are stacked one upon the other.

12. A high chair comprising:

a high chair support structure having a seating end and base end, the seating end and base end each being configured to stably rest on a support surface;

a seating surface coupled to the support structure, wherein the seating surface is located at an elevated position above the support surface when the base end rests on the support surface;

a stabilizer coupled to the support structure, the stabilizer being movable between an extended and retracted position and being configured to engage the support surface when in one of the extended and retracted positions to facilitate further stabilization of the support structure when one of the base end and seating end rests on the support surface.

13. A stabilizer for a freestanding high chair having a seating surface coupled to a support structure, the support structure having a seating end and a base end, the seating surface being supported at an elevated position above the support surface when the base end of the support structure rests thereon, the stabilizer comprising:

a stabilizer body having a support surface engagement portion; and a support structure engagement portion configured for coupling the stabilizer body to the support structure so that the stabilizer body is movable between extended and retracted positions relative to the support structure so that the support surface engagement portion selectively engages the support surface when the seating end of the support structure rests on the support surface and the stabilizer body is one of the extended and retracted positions.

14. The stabilizer of claim 12, wherein:

the stabilizer serves as a seat back.

15. The stabilizer of claim 13, wherein:

the stabilizer forms a seat back of the high chair.

16. The high chair of claim 1, wherein:

the stabilizer serves as a seat back.

17. The high chair of claim 8, wherein:

the stabilizer serves as a seat back.

* * * * *